US010465119B2

(12) United States Patent
Endou et al.

(10) Patent No.: US 10,465,119 B2
(45) Date of Patent: Nov. 5, 2019

(54) EXTERNALLY HEATED CARBONIZATION FURNACE

(71) Applicant: MITSUBISHI HEAVY INDUSTRIES ENVIRONMENTAL & CHEMICAL ENGINNERING CO., LTD., Yokohama-shi, Kanagawa (JP)

(72) Inventors: Yuuki Endou, Yokohama (JP); Hirotami Yamamoto, Yokohama (JP); Keiichi Ishikawa, Yokohama (JP); Ryosuke Koizumi, Yokohama (JP)

(73) Assignee: MITSUBISHI HEAVY INDUSTRIES ENVIRONMENTAL & CHEMICAL ENGINEERING CO., LTD., Yokohama-Shi, Kanagawa (JP)

( * ) Notice: Subject to any disclaimer, the term of this patent is extended or adjusted under 35 U.S.C. 154(b) by 201 days.

(21) Appl. No.: 15/031,501

(22) PCT Filed: Nov. 11, 2014

(86) PCT No.: PCT/JP2014/079850
§ 371 (c)(1),
(2) Date: Apr. 22, 2016

(87) PCT Pub. No.: WO2015/072453
PCT Pub. Date: May 21, 2015

(65) Prior Publication Data

US 2016/0264872 A1 Sep. 15, 2016

(30) Foreign Application Priority Data

Nov. 13, 2013 (JP) ..... 2013-235126

(51) Int. Cl.
*C10B 47/30* (2006.01)
*F27B 7/02* (2006.01)
(Continued)

(52) U.S. Cl.
CPC ..... *C10B 47/30* (2013.01); *C10B 1/10* (2013.01); *C10B 57/02* (2013.01); *F27B 7/02* (2013.01);
(Continued)

(58) Field of Classification Search
CPC . C10B 1/10; C10B 47/30; C10B 57/02; F27B 7/02; F27B 7/08; F27B 7/26; F27B 7/34; F27B 7/42
See application file for complete search history.

(56) References Cited

U.S. PATENT DOCUMENTS 1,632,052 A * 6/1927 Zwoyer ..... C10B 1/10 44/598
1,748,815 A * 2/1930 Wisner ..... C10B 1/10 202/218
(Continued)

FOREIGN PATENT DOCUMENTS

CN 101020826 A 8/2007
CN 101231144 A 7/2008
(Continued)

OTHER PUBLICATIONS

WO2013118725_A1_ENG (Espacenet machine translation of Uekawa) (Year: 2013).*
(Continued)

*Primary Examiner* — Youngsul Jeong
*Assistant Examiner* — Gabriel E Gitman
(74) *Attorney, Agent, or Firm* — Manabu Kanesaka; Benjamin Hauptman; Kenneth Berner

(57) ABSTRACT

Provided is an externally heated carbonization furnace that includes a plurality of rotary kilns connected in series, each of which includes an outer cylinder, a kiln inner cylinder that rotate relative to the outer cylinder, and a heater that supplies heating gas to a section between the outer cylinder and the
(Continued)

kiln inner cylinder. The externally heated carbonization furnace further includes a drive device that rotates at least one of the kiln inner cylinders and the kiln inner cylinder different from the at least one of the kiln inner cylinders and a control device that controls the drive device according to moisture content of a treated object in the kiln inner cylinder.

4 Claims, 2 Drawing Sheets

(51) Int. Cl.

| | |
|---|---|
| ***F27B 7/08*** | (2006.01) |
| ***F27B 7/42*** | (2006.01) |
| ***C10B 57/02*** | (2006.01) |
| ***F27B 7/26*** | (2006.01) |
| ***F27B 7/34*** | (2006.01) |
| ***C10B 1/10*** | (2006.01) |

(52) U.S. Cl.
CPC ..... *F27B 7/08* (2013.01); *F27B 7/26* (2013.01); *F27B 7/34* (2013.01); *F27B 7/42* (2013.01)

(56) References Cited

U.S. PATENT DOCUMENTS

| | | | | | |
|---|---|---|---|---|---|
| 1,946,628 | A * | 2/1934 | Komarek | C10B 1/10 | 201/23 |
| 1,967,762 | A * | 7/1934 | Wisner | C10L 31/10 | 202/218 |
| 3,436,061 | A * | 4/1969 | Zinn | F23G 5/20 | 110/246 |
| 3,627,287 | A * | 12/1971 | Herz | F27B 7/42 | 106/743 |
| 3,787,292 | A * | 1/1974 | Keappler | C10B 1/10 | 202/118 |
| 3,802,847 | A * | 4/1974 | Hara | F27B 7/06 | 422/199 |
| 3,838,848 | A * | 10/1974 | Jaquay | F27B 7/00 | 266/173 |
| 3,982,052 | A * | 9/1976 | Bearce | C10B 1/10 | 44/501 |
| 4,087,334 | A * | 5/1978 | Harig | B01J 2/12 | 202/269 |
| 4,125,437 | A * | 11/1978 | Bacon | C10B 1/10 | 198/658 |
| 4,193,756 | A * | 3/1980 | Leon | F27B 7/24 | 277/389 |
| 5,395,463 | A * | 3/1995 | Johnen | B22F 1/0088 | 148/513 |
| 5,788,481 | A * | 8/1998 | Von Beckmann | F27B 7/02 | 110/246 |
| 5,997,288 | A * | 12/1999 | Adams | C10B 1/10 | 110/226 |
| 6,042,370 | A * | 3/2000 | Weide | F27B 7/02 | 432/103 |
| 8,002,972 | B2 * | 8/2011 | Morris, Jr. | C01B 3/50 | 201/15 |
| 2011/0065058 | A1 * | 3/2011 | Kumagai | F27B 7/20 | 432/112 |

FOREIGN PATENT DOCUMENTS

| | | | | |
|---|---|---|---|---|
| DE | 3826894 | A1 * | 2/1990 | F23G 5/20 |
| JP | H09-024392 | A | 1/1997 | |
| JP | 2001-311584 | A | 11/2001 | |
| JP | 2003-075069 | A | 3/2003 | |
| JP | 2005-112956 | A | 4/2005 | |
| JP | 2008-180451 | A | 8/2008 | |
| JP | 4352596 | B2 | 10/2009 | |
| JP | 2013-015301 | A | 1/2013 | |
| JP | 5116883 | B2 | 1/2013 | |
| JP | 5235308 | B2 | 7/2013 | |
| JP | WO2013118725 | A1 * | 8/2013 | C21B 11/06 |
| WO | WO2012158110 | A1 * | 11/2012 | C10L 5/44 |
| WO | 2013/042280 | A1 | 3/2013 | |
| WO | WO2013042280 | A1 * | 3/2013 | F27B 7/02 |

OTHER PUBLICATIONS

DE3826894A1_ENG (Espacenet machine translation of Boehler) (Year: 1990).*
WO2013042280A1_ENG (Espacenet machine translation of Yamamoto) (Year: 2013).*
PCT/ISA/210, "International Search Report for International Application No. PCT/JP2014/079850," dated Feb. 10, 2015.
PCT/ISA/237, "Written Opinion of the International Searching Authority for International Application No. PCT/JP2014/079850," dated Feb. 10, 2015.
Japan Patent Office, "Office Action for Japanese Patent Application No. 2013-235126," dated Feb. 3, 2015.
China Patent Office, "Office Action for Chinese Patent Application No. 201480058607.3," dated May 22, 2017.
Sun Li Etc., The 128-129 page or leaf., Chemical Industry Publishing House., Open Day., On Jun. 30, 2011.

* cited by examiner

EXTERNALLY HEATED CARBONIZATION FURNACE

TECHNICAL FIELD

The present invention relates to an externally heated carbonization furnace that includes an outer cylinder, an inner cylinder that rotates relatively to the outer cylinder, and a heater that supplies heating gas to a section between the outer cylinder and the inner cylinder, the externally heated carbonization furnace producing a carbide from a treated object, such as woody biomass and the like.

This application claims priority based on Japanese Patent Application No. 2013-235126 filed in Japan on Nov. 13, 2013, of which the contents are incorporated herein by reference.

BACKGROUND ART

An externally heated carbonization furnace (an externally heated pyrolysis gasification furnace) is intended to modify a low-calorie substance (a low-grade substance) having high moisture content. The externally heated carbonization furnace produces a carbide with an improved calorific power, by indirectly heating mainly sewage sludge, woody biomass, low-grade coal, or the like at high temperatures ranging from 300° C. to 700° C. under the condition in which oxygen is cut off.

Known examples of a method for producing carbide include high-temperature carbonization in which a treated object is indirectly heated at high temperatures ranging from 500° C. to 700° C., and semi-carbonization (torrefaction) in which the treated object is indirectly heated at temperatures around 300° C. With the high-temperature carbonization, securing a sufficient treatment time under a predetermined temperature makes it possible to achieve carbide production that suppresses a high gasification rate and self-heat generation. With the semi-carbonization, controlling the temperature within an extremely narrow range with respect, in particular, to woody biomass makes it possible to achieve carbide production that strikes a balance between pulverizability and the residual ratio of heat quantity.

Further, known examples of the externally heated carbonization furnace include an externally heated rotary kiln that includes a kiln inner cylinder that rotates about an axis thereof and an outer cylinder that circulates heating gas around the kiln inner cylinder. The externally heated rotary kiln carries out a heat treatment while transferring the treated object (low-calorie substance) in the axial direction inside the kiln inner cylinder. Another known example is an externally heated rotary kiln divided into a former stage and a latter stage, which a treated object is dried in the former stage and carbonized in the latter stage (see Patent Document 1).

CITATION LIST

Patent Literature

Patent Document 1: Japanese Unexamined Patent Application Publication No. H09-24392A

SUMMARY OF INVENTION

Technical Problem

Incidentally, because it is typical that the low-calorie substance to be treated, such as biomass or low-grade coal, significantly fluctuate in moisture content, there has been a case in which a dryer is installed in the stage prior to the externally heated carbonization furnace so as to suppress the fluctuations in the moisture content. However, in this case, it is difficult to control the moisture content to be constant at an outlet of the dryer after the drying process.

When carbide is produced by the high-temperature carbonization, fluctuations in moisture content result in a deterioration in the gasification ratio, a worsening of the equipment fuel consumption, and also, an acceleration in the self-heat generation of the carbide. Thus, from a view point of using the carbide as fuel, there has been a demand for a stable processing.

Further, when carbide is produced by the semi-carbonization, if fluctuations in moisture content cause the carbonization temperature to decrease, the pulverizability deteriorates, and if the fluctuations in the moisture content cause the carbonization temperature to increase, the residual ratio of heat quantity deteriorates. Thus, stringent temperature control is required.

Furthermore, when carbide is produced using the externally heated rotary kiln, the kiln inner cylinder is segmented into an evaporation zone in which the moisture contained in the treated object is evaporated in the former stage and a carbonization (gasification) zone in which the treated object is carbonized in the latter stage.

In order to achieve the carbonization of stable quality with respect to the fluctuations in the moisture content of the treated object, it is necessary to adjust the degree of carbonization in the carbonization zone in accordance with the moisture content. However, because the latent heat of vaporization of water requires an extremely large amount of heat compared with the latent heat of gasification of the volatile component, it is not possible to ignore the influence of the fluctuations in the moisture content on the degree of carbonization.

For example, in a commonly-used externally heated rotary kiln, when the moisture content of the treated object fluctuates, the evaporation zone in the former stage is extended, and the carbonization zone in the latter stage is shortened. As a result, the degree of carbonization decreases. Due to this, in the commonly-used externally heated rotary kiln, a problem arises more specifically from a view point of suppressing the self-heat generation of the carbide. In order to avoid this problem, while assuming a state in which the moisture content has increased and the evaporation zone in the former stage has been extended, the heat transfer surface area between the kiln inner cylinder and the treated object has been set as appropriate, and temperature control has been performed. However, even when this type of control is used, there is still a problem concerning a deterioration in thermal efficiency.

Further, with respect to the temperature control, it is necessary to heat the treated object (moisture and a solid component) remaining inside the kiln, through the kiln inner cylinder, which is a heating unit of the externally heated rotary kiln. Thus, with respect to sudden fluctuations in the moisture content, the responsiveness of the temperature control is not sufficient when only adjusting the amount of heating gas.

A carbonization furnace disclosed in Patent Document has a configuration in which each of the flow rates of the heating gas introduced to the former stage and the latter stage of the kiln can be adjusted separately. However, when the moisture content significantly fluctuates, the responsiveness of the temperature control is still not sufficient enough when only adjusting the amount of heating gas.

An object of the present invention is to provide an externally heated carbonization furnace capable of stably producing carbide even when moisture content of a treated object to be fed fluctuates.

Solution to Problem

According to a first aspect of the present invention, an externally heated carbonization furnace includes a plurality of rotary kilns connected in series, each of the rotary kilns including an outer cylinder, a kiln inner cylinder that rotates relative to the outer cylinder, and a heater that supplies heating gas to a section between the outer cylinder and the kiln inner cylinder; a drive device that individually rotates at least one of the kiln inner cylinders and the kiln inner cylinder different from the at least one of the kiln inner cylinders; and a control device that controls the drive device according to moisture content of a treated object in the kiln inner cylinder.

According to the above-described configuration, by controlling the rotational frequency of the kiln inner cylinder in each of the plurality of rotary kilns according to the moisture content of the treated object, it is possible to stably produce carbide even when the moisture content of the treated object to be fed fluctuates.

In the above-described externally heated carbonization furnace, the rotational frequencies of the kiln inner cylinders may be controlled by at least one of a temperature of the kiln inner cylinder on an upstream side and a temperature of the kiln inner cylinder on a downstream side.

According to the above-described configuration, as a result of estimating the moisture content of the treated object using the temperatures of the kiln inner cylinders, it is possible to ascertain the fluctuations in the moisture content of the treated object without directly measuring the moisture content of the treated object.

In the above-described externally heated carbonization furnace, the control device may include a heating gas amount adjustment device that adjusts a flow rate of the heating gas supplied from the heater.

According to the above-described configuration, as a result of controlling the rotational frequencies of the kiln inner cylinders as well as adjusting the amount of heating gas, it is possible to handle significant fluctuations in the moisture content.

In the above-described externally heated carbonization furnace, a connecting portion that mutually connects the plurality of kiln inner cylinders includes a downstream cylindrical portion that communicates with an internal space of the kiln inner cylinder on the downstream side and that rotates together with the kiln inner cylinder on the downstream side, and an upstream cylindrical portion that communicates with an internal space of the kiln inner cylinder on the upstream side, that rotates together with the kiln inner cylinder on the upstream side, and that is inserted into an inner circumferential side of the downstream cylindrical portion in a radial direction.

According to the above-described configuration, as a result of causing the internal space of the kiln inner cylinder on the upstream side and the internal space of the kiln inner cylinder on the downstream side to be directly communicated with each other, it is possible to minimize a section that is not heated by the heating gas.

In the above-described externally heated carbonization furnace, the connecting portion may be configured to tightly seal the plurality of kiln inner cylinders with each other on an outer circumferential side of the upstream cylindrical portion and the downstream cylindrical portion in the radial direction. Further, the connecting portion may include an expansion member that is expandable in an axial direction of the outer cylinders.

According to the above-described configuration, it is possible to inhibit the air from flowing into the kiln inner cylinders and also to absorb the thermal expansion of the kiln cylindrical body by the expansion member.

The above-described externally heated carbonization furnace may further include a movable support portion provided in an end portion of the at least one of the kiln inner cylinders in the connecting portion, the movable support portion being movable in the axial direction and rotatably supporting the at least one of the kiln inner cylinders about an axis of at least one of the kiln inner cylinders; and a fixed support portion provided in an end portion of the kiln inner cylinder different from the at least one of the kiln inner cylinders in the connecting portion, the fixed support portion being immovable in the axial direction and rotatably supporting the kiln inner cylinder different from the at least one of the kiln inner cylinders about an axis of the kiln inner cylinder.

According to the above-described configuration, it is possible to absorb the thermal expansion of the kiln cylindrical body using the movable support portion.

Advantageous Effect of Invention

According to the present invention, by controlling the rotational frequency of the kiln inner cylinder in each of the plurality of rotary kilns according to the moisture content of the treated object, it is possible to stably produce carbide even when the moisture content of the treated object to be fed fluctuates.

DESCRIPTION OF EMBODIMENTS

Figure 1:
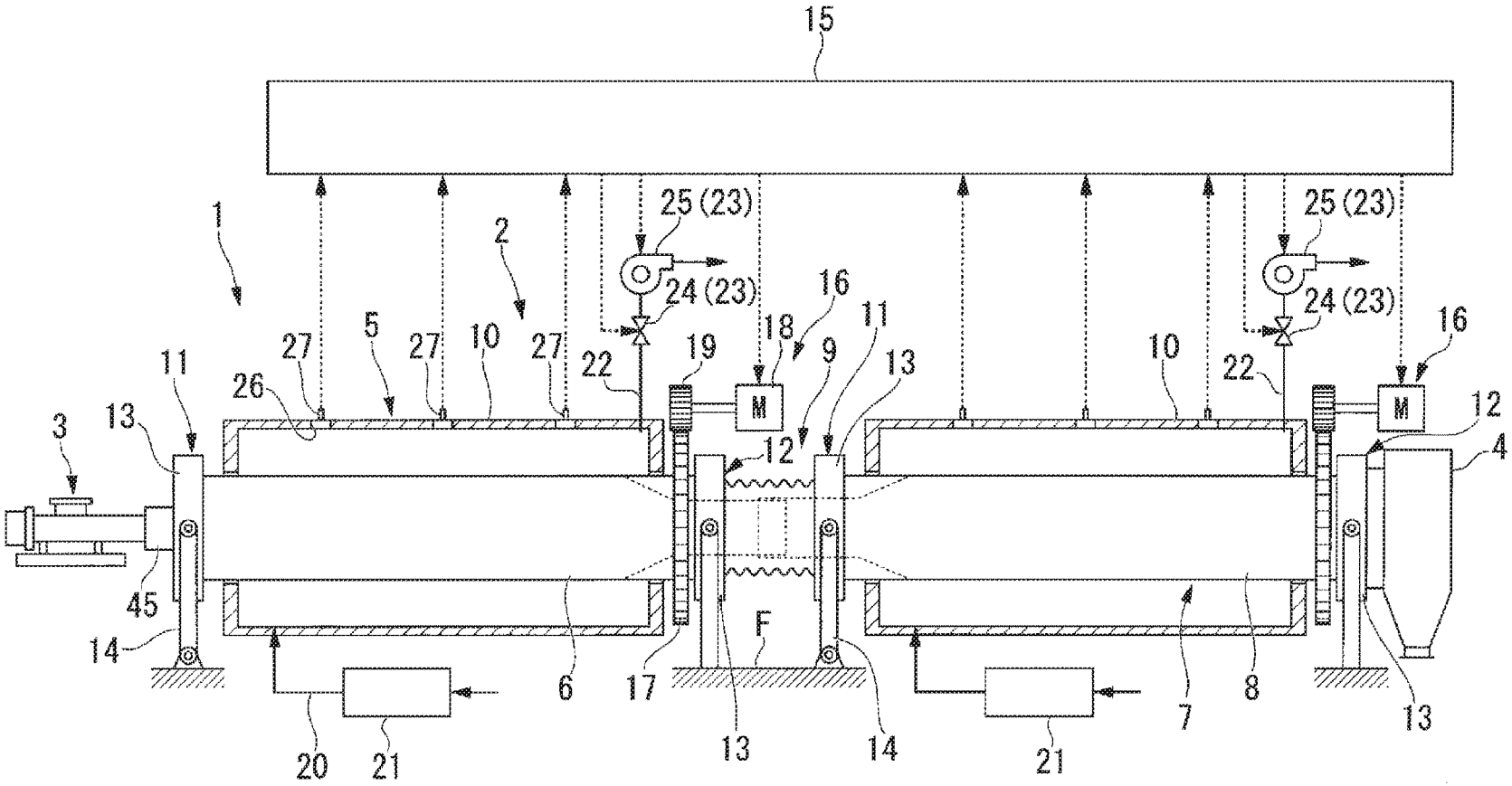
FIG. 1 is a schematic configuration diagram of an example of carbide production equipment according to an embodiment of the present invention.

An externally heated carbonization furnace 2 according to an embodiment of the present invention will be described below in detail with reference to the accompanying drawings. FIG. 1 is a schematic configuration diagram of an example of carbide production equipment 1 that is provided with the externally heated carbonization furnace 2 of the present embodiment.

As illustrated in FIG. 1, the carbide production equipment 1 includes a screw conveyor 3 for feeding a treated object, the externally heated carbonization furnace 2 that heats the treated object fed from the screw conveyor 3, and a chute 4 that discharges the treated object discharged from the externally heated carbonization furnace 2.

The externally heated carbonization furnace 2 carries out a heat treatment on the treated object, which is a low-caloric substance, such as sewage sludge, woody biomass, or low-grade coal, and modifies the treated object to a carbide having a large calorific power.

The externally heated carbonization furnace 2 includes a first rotary kiln 5 and a second rotary kiln 7 that is connected in series to the downstream side of the first rotary kiln 5 that heats the treated object discharged from the first rotary kiln 5. The first rotary kiln 5 includes an outer cylinder 10 and a first kiln inner cylinder 6 (a kiln shell) which rotates relatively to the outer cylinder 10 and into which the treated object is fed. The second rotary kiln 7 includes the outer cylinder 10 and a second kiln inner cylinder 8 which rotates relatively to the outer cylinder 10 and into which the treated object is fed.

A combination of the first kiln inner cylinder 6 and the second kiln inner cylinder 8 form a large cylindrical body. A length L of the cylindrical body in the axial direction is approximately 50 m, for example. Further, the first kiln inner cylinder 6, the second kiln inner cylinder 8, and the outer cylinder 10 are installed on an installation surface F, while being inclined at a gradient of 1% to 3% with respect to the horizon.

Note that, in the description below, the axial direction of the kiln inner cylinders 6 and 8 and the outer cylinder 10 (described below) will be simply referred to as the axial direction.

The first rotary kiln 5 and the second rotary kiln 7 have substantially the same configuration. The configuration of the first rotary kiln 5 will be described below.

The first rotary kiln 5 includes the first kiln inner cylinder 6 and the outer cylinder 10 (a muffle) that circulates heating gas around the first kiln inner cylinder 6. The first kiln inner cylinder 6 is supported at the upstream side thereof by a movable support portion 11, which is movable in the axial direction, so as to be able to rotate about the axis thereof. The first kiln inner cylinder 6 is supported at the downstream side thereof by a fixed support portion 12 so as to be able to rotate about the axis thereof.

The movable support portion 11 of the first kiln inner cylinder 6 includes a ring-shaped frame 13 that rotatably supports the first kiln inner cylinder 6. The ring-shaped frame 13 is rotatably supported at both sides thereof by upper end portions of support members 14 that are provided vertically from the installation surface F in a pivotable manner. The fixed support portion 12 also includes the ring-shaped frame 13 that rotatably supports the first kiln inner cylinder 6.

Note that the movable support portion 11 and the fixed support portion 12 can be installed on opposite sides to those described in the present embodiment.

A plurality of fins (or spirals, not illustrated in the drawings) arranged inclining with respect to the circumferential direction are provided on the inner wall of the first kiln inner cylinder 6. As a result of being driven to rotate by a drive device 16, which will be described below, at a predetermined rotational frequency (one to five rpm, for example), the first kiln inner cylinder 6 can transfer the treated object, which is fed from an inlet side (the upstream side), to an outlet side (the downstream side) while heating the treated object. Note that, instead of providing the fins, the first kiln inner cylinder 6 may be rotatably supported about an axis which is slightly inclined with respect to the horizon, thereby transferring the treated object to the outlet side due to the inclination and the rotation of the first kiln inner cylinder 6.

The drive device 16 includes a gear 17 provided to the first kiln inner cylinder 6, a drive motor 18, and a pinion gear 19 that is attached to a rotating shaft of the drive motor 18 and engaged with the gear 17. The drive device 16 rotates the first kiln inner cylinder 6 about the axis of the first kiln inner cylinder 6 by transmitting the driving force of the drive motor 18 to the gear 17 so as to rotate the gear 17.

The outer cylinder 10 is fixed to an installation area via a support member (not illustrated), while allowing the first kiln inner cylinder 6 to rotate and to move in the axial direction, and securing sealing between the outer cylinder 10 and the first kiln inner cylinder 6.

A heating gas supply pipe 20 is connected to a first end portion of the outer cylinder 10. A second end portion positioned on the opposite side of the first end portion of the outer cylinder 10, to which the heating gas is supplied from a heating gas combustion furnace 21 (a heater for supplying the heating gas) through the heating gas supply pipe 20 is connected with a heating gas feeding pipe 22. A heating gas amount adjustment damper 24 (a heating gas amount adjustment device 23) and an induction fan 25 are provided in the heating gas feeding pipe 22.

A plurality of inspection windows 26 are provided in an upper portion of the outer cylinder 10 at intervals in the axial direction. A non-contact type thermometer 27 is provided in each of the inspection windows 26 to face the outer circumferential surface of the kiln inner cylinder that rotates about the axis thereof. The non-contact type thermometer 27 measures a kiln shell temperature (an iron shell temperature of the kiln inner cylinder). A radiation thermometer can be used as the non-contact type thermometer 27.

The externally heated carbonization furnace 2 includes a control device 15. The control device 15 and each of the non-contact-type thermometers 27 are connected so as to be able to communicate with each other. The kiln shell temperature measured by the non-contact type thermometer 27 is input into the control device 15. Further, the control device 15 controls the heating gas amount adjustment device 23 and the drive device 16 on the basis of the kiln shell temperature. A control method of the control device 15 will be described later.

Next, details of the ring-shaped frame 13 and a connecting portion 9 between the first rotary kiln 5 and the second rotary kiln 7 will be described.

Figure 2:
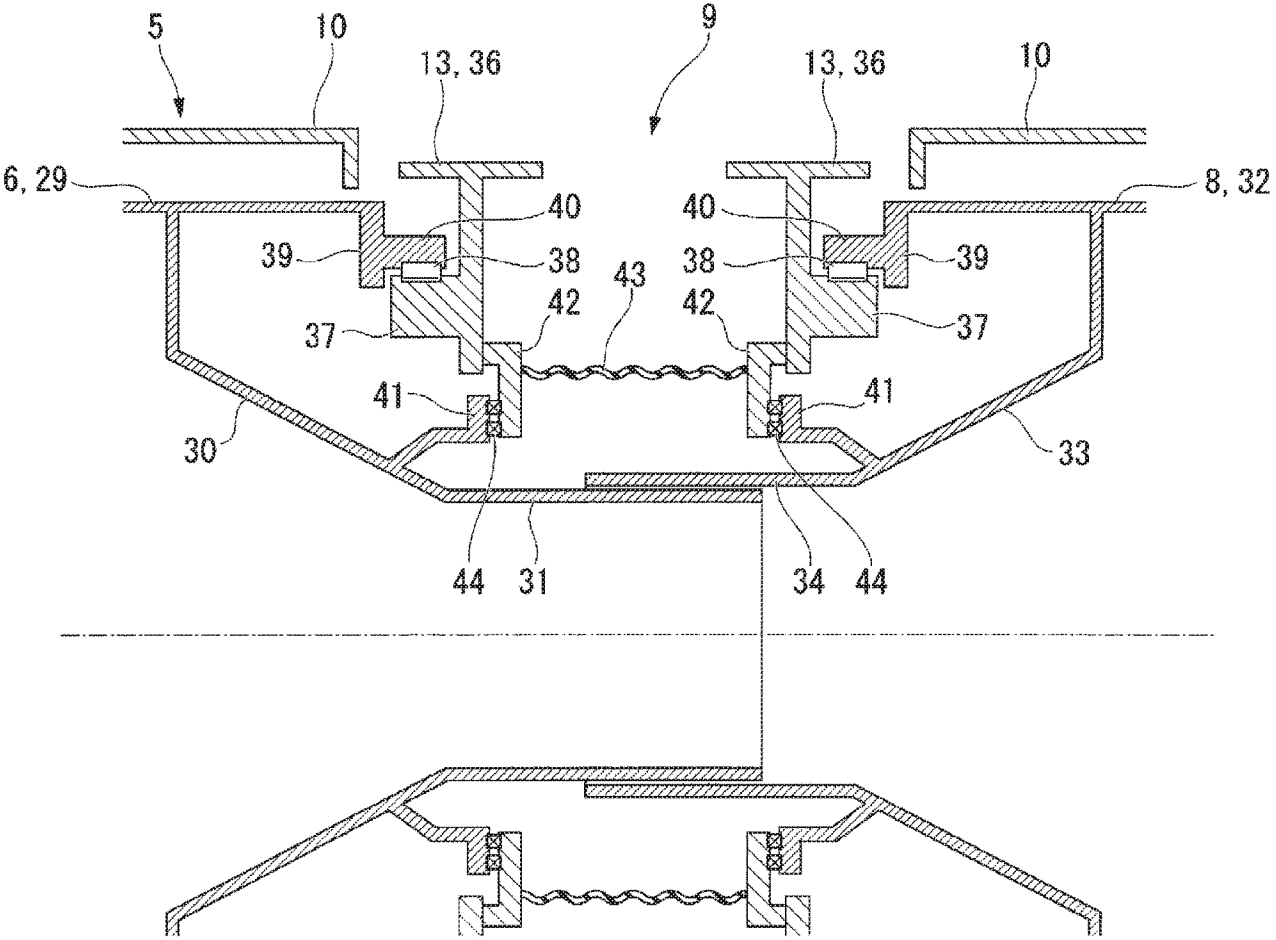
FIG. 2 is a detailed diagram of a connecting portion between a first rotary kiln and a second rotary kiln in an externally heated carbonization furnace according to the embodiment of the present invention.

As illustrated in FIG. 2, the first kiln inner cylinder 6 includes a first inner cylinder main body portion 29 formed to have a substantially constant diameter of, for example, approximately 5 m in the axial direction, a first conical portion 30 whose diameter is gradually reduced as the first conical portion 30 extends further toward the downstream side in the axial direction from the downstream side of the first kiln inner cylinder 6 so as to be formed into a conical shape, and a first small diameter portion 31 (an upstream-side cylindrical portion) that is formed in a cylindrical shape and extends from the first conical portion 30 toward the downstream side in the axial direction while having a substantially constant diameter.

The second kiln inner cylinder 8 of the second rotary kiln 7 includes a second inner cylinder main body portion 32 formed to have a substantially constant diameter of, for example, approximately 5 m in the axial direction, a second conical portion 33 whose diameter is gradually reduced as the second conical portion 33 extends further toward the upstream side in the axial direction from the upstream side of the second kiln inner cylinder 8, and a second small diameter portion 34 (a downstream-side cylindrical portion) that is formed in a cylindrical shape and extends from the second conical portion 33 toward the upstream side in the axial direction while having a substantially constant diameter.

The first small diameter portion 31 of the first kiln inner cylinder 6 has an outer diameter slightly smaller than the inner diameter of the second small diameter portion 34 of the second kiln inner cylinder 8. Specifically, the first small diameter portion 31 and the second small diameter portion 34 are formed so that the first small diameter portion 31 can be inserted into the second small diameter portion 34.

In the connecting portion 9 between the first rotary kiln 5 and the second rotary kiln 7, the first small diameter portion 31 is inserted into the second small diameter portion 34. Specifically, the first small diameter portion 31 is inserted into the inner circumferential side of the second small diameter portion 34 in the radial direction. The first small diameter portion 31 and the second. small diameter portion 34 are disposed so that the central axes thereof are aligned on the same straight line. Accordingly, the first small diameter portion 31 and the second small diameter portion 34 are disposed so as to partially overlap with each other in the axial direction. Such a structure makes it possible to smoothly transfer the treated object from the first kiln inner cylinder 6 to the second kiln inner cylinder 8.

The ring-shaped frames 13 are provided on the outer circumferential side of the conical portions 30 and 33 or the small diameter portions 31 and 34. Each of the ring-shaped frames 13 includes a frame main body portion 36 that extends in the circumferential direction, and a bearing retaining portion 37 that protrudes toward the kiln inner cylinder 6 or 8 on the inner circumferential side of the frame main body portion 36. The bearing retaining portion 37 extends in the circumferential direction and retains a bearing 38 on the outer circumferential side of the bearing retaining portion 37. The bearings 38 rotatably support the kiln inner cylinders 6 and 8 via ring-shaped protrusions 40 that protrude from end wall portions 39 of the kiln inner cylinder 6 and 8 in the axial direction.

Specifically, the kiln inner cylinders 6 and 8 are rotatably supported via the ring-shaped frames 13. Each of the ring-shaped frames 13 is supported by the support member 14 (see FIG. 1) that is provided vertically from the installation surface F.

Next, a sealing mechanism in the connecting portion 9 will be described.

The connecting portion 9 between the first rotary kiln 5 and the second rotary kiln 7 includes sealing plates 41 that protrude from the outer circumferential surface of the conical portions 30 and 33 or the small diameter portions 31 and 34 of the kiln inner cylinders 6 and 8 toward the outer circumferential side in the radial direction and extend in the circumferential direction; ring-shaped presser plates 42 each attached to the ring-shaped frame 13; an expansion member 43 provided so as to cover the outer circumferential side of the small diameter portions 31 and 34; and gland packings 44 each disposed between the sealing plate 41 and the presser plate 42.

The sealing plates 41 provided to the kiln inner cylinders 6 and 8 rotate together with the kiln inner cylinders 6 and 8. The gland packings 44 are fixed to the sealing plates 41 and rotate together with the sealing plates 41. In this case, as a result of the gland packings 44 sliding against sliding surfaces of the presser plates 42, sealing is obtained. The expansion member 43 is formed in a bellows and substantially cylindrical shape. The bellows-shaped portion of the expansion member 43 is expandable in the axial direction.

Carbon fiber gland packings can be adopted as the gland packings 44, for example. Because the gland packings 44 formed by weaving carbon fibers have an extremely small friction coefficient, the sealing performance can be maintained for a long period of time.

Note that, as illustrated in FIG. 1, in a connecting part between the movable support portion 11 of the first rotary kiln 5 and the screw conveyor 3, an expansion member 45 is provided that absorbs displacement of the movable support portion 11 in the axial direction.

Next, the control device 15 of the externally heated carbonization furnace 2 according to the present embodiment will be described. The control device 15 controls the amount of heating gas and the rotational frequency of the kiln inner cylinder on the basis of the kiln shell temperature detected by each of the plurality of non-contact type thermometers 27. The kiln shell temperature detected by each of the plurality of non-contact type thermometers 27 is transmitted to the control device 15.

Because the kiln shell temperature is a temperature of the section that directly comes into contact with the treated object inside the kiln inner cylinder, the kiln shell temperature is highly correlated with the thermal decomposition temperature of the treated object, and thus favorably reflects the heating condition. Therefore, as a result of performing the temperature control on the basis of the kiln shell temperature, it becomes possible to control the heating temperature in a stable manner. Particularly, the kiln shell temperature fluctuates depending on the moisture content of the treated object. When the moisture content of the treated object increases, evaporation of the moisture increases. As a result, the kiln shell temperature decreases. The control device 15 of the present embodiment uses the kiln shell temperature to estimate the moisture content of the treated object.

Because the externally heated carbonization furnace 2 of the present embodiment includes two of the rotary kilns 5 and 7 on the upstream side and the downstream side thereof, the control device 15 can individually control the amounts of heating gas and rotational frequencies of the kiln inner cylinders of the rotary kilns 5 and 7.

Here, in the externally heated carbonization furnace 2 of the present embodiment, the kiln inner cylinder is divided into the upstream side and the downstream side. The first kiln inner cylinder 6 functions as an evaporation zone in which the moisture in the treated object is evaporated, and the second kiln inner cylinder 8 functions as a carbonization zone in which the treated object is carbonized.

The control device 15 adjusts the amount of heating gas by controlling the degree of opening of the heating gas amount adjustment damper 24 and the rotational frequency of the induction fan 25, so that the kiln shell temperature measured by each of the plurality of non-contact type thermometers 27 is maintained within a predetermined temperature range.

When the kiln shell temperature cannot be maintained within the predetermined temperature range even by adjusting the amount of heating gas, the evaporation of the treated object is accelerated by increasing the rotational frequency (increasing the rotation speed) of the first kiln inner cylinder 6. The kiln shell temperature decreases as a result of the evaporation from the treated object increasing.

As described above, the externally heated carbonization furnace 2 of the present embodiment is divided into the rotary kiln (kiln inner cylinder) that functions as the evaporation zone and the rotary kiln (kiln inner cylinder) that functions as the carbonization zone. Thus, even when the rotational frequency of the first kiln inner cylinder 6 of the first rotary kiln 5 is increased, it is possible to maintain the rotational frequency of the second kiln inner cylinder 8 of the second rotary kiln 7 as it is. Specifically, even when the rotational frequency of the first kiln inner cylinder 6 is increased so as to accelerate the evaporation of the moisture from the treated object, it is possible to maintain the rotational frequency of the second kiln inner cylinder 8, in which carbonization processing is performed.

In other words, even when the moisture content of the treated object is high, it is possible to cause the treated object, which is fed into the carbonization zone (the second kiln inner cylinder 8), to have an appropriate level of moisture content by accelerating evaporation processing performed in the evaporation zone (the first kiln inner cylinder 6).

Further, in a case in which an externally heated carbonization furnace includes only one kiln inner cylinder, when the evaporation zone becomes longer, the carbonization zone becomes shorter accordingly. However, by providing the evaporation zone and the carbonization zone independently from each other, and also by adjusting the degree of evaporation by controlling the rotational frequency of the kiln inner cylinder as well as the amount of heating gas, the degree of carbonization in the carbonization zone is not affected.

According to the above-described embodiment, controlling the respective rotational frequencies of the kiln inner cylinders 6 and 8 in the two rotary kilns 5 and 7 according to the moisture content of the treated object, a stable production of carbide becomes possible even when the moisture content of the treated object to be fed fluctuates. Specifically, it is possible to maintain the rotational frequency of the second kiln inner cylinder 8, while changing the rotational frequency of the first kiln inner cylinder 6.

More specifically, in a case when the moisture content of the treated object becomes high, and it is thus not possible to achieve an appropriate level of evaporation only by adjusting the amount of heating gas in the first kiln inner cylinder 6, which functions as the evaporation zone, it is possible to increase the rotational frequency (increase the rotation speed) of the first kiln inner cylinder 6 by using the control device 15. Accordingly, even when the moisture content of the treated object becomes high, it is possible to reduce the moisture content of the treated object to an appropriate level in the evaporation zone.

Further, as a result of having a structure in which two kiln inner cylinders are connected to each other in series, even when a large rotary kiln is used, it is possible to expand the heat transfer surface area, while avoiding an impact on the structural strength of the rotary kiln.

Further, as a result of estimating the moisture content of the treated object using the kiln shell temperature, it is possible to ascertain the fluctuations in the moisture content of the treated object, without directly measuring the moisture content of the treated object.

Furthermore, as a result of controlling the rotational frequency of the kiln inner cylinder as well as adjusting the amount of heating gas, it is possible to handle significant fluctuations in the moisture content. Specifically, even when the responsiveness of the temperature control is not sufficient when only adjusting the amount of heating gas, the temperature control becomes possible.

Further, in the connecting portion 9 between the first kiln inner cylinder 6 and the second kiln inner cylinder 8, the internal space of the first kiln inner cylinder 6 and the internal space of the second kiln inner cylinder 8 directly communicate with each other. As a result, it is possible to minimize a section that is not heated by the heating gas.

Further, in the connecting portion 9 between the first kiln inner cylinder 6 and the second kiln inner cylinder 8, the expansion member 43 is provided that causes the kiln inner cylinders 6 and 8 to be tightly sealed with each other. As a result, air is inhibited from flowing into the kiln inner cylinders 6 and 8, and also, the thermal expansion of the kiln inner cylinders 6 and 8 can be absorbed by the expansion member 43.

Furthermore, as a result of the one end portion of each of the kiln inner cylinders 6 and 8 being supported by the movable support portion 11, which is movable in the axial direction, the thermal expansion of the kiln inner cylinders 6 and 8 can be absorbed. Specifically, even when the kiln inner cylinders 6 and 8 are maintained at high temperatures ranging from 300° C. to 700° C., sealability of a sliding section of the connecting portion 9 can be maintained.

The embodiment of the present invention has been described above in detail with reference to the accompanying drawings. However, each of the configurations described in each of the embodiments, combinations thereof, and the like are merely examples, and it is possible to add a configuration, or omit, replace, or modify the above-described configuration without departing from the spirit of the present invention. Further, the present invention is not limited by the above-described embodiment, but only limited by the scope of the claims.

For example, in the externally heated carbonization furnace 2 of the present embodiment, the amount of heating gas and the rotational frequency of the kiln inner cylinder are controlled on the basis of the kiln shell temperature, but the control method is not limited to this example. For example, the present invention may have a configuration in which a thermometer is provided inside the kiln inner cylinder, and the temperature of the treated object may be directly measured by the thermometer.

Further, in the externally heated carbonization furnace 2 of the present embodiment, the kiln inner cylinder is divided into the first kiln inner cylinder 6 on the upstream side and the second kiln inner cylinder 8 on the downstream side. However, the present invention is not limited to this example, and the kiln inner cylinder may be divided into three or more parts. Specifically, a configuration may be adopted in which three or more kiln inner cylinders are connected with each other.

Further, the number of the non-contact type thermometers is also not limited to three, but the installation number can be chosen as desired.

INDUSTRIAL APPLICABILITY

According to this externally heated carbonization furnace, by controlling the rotational frequency of the kiln inner cylinder in each of the plurality of rotary kilns according to the moisture content of the treated object, it is possible to stably produce carbide even when the moisture content of the treated object to be fed fluctuates,

REFERENCE SIGNS LIST

1 Carbide production equipment
2 Externally heated carbonization furnace
3 Screw conveyor
4 Chute
5 First rotary kiln
6 First kiln inner cylinder
7 Second rotary kiln
8 Second kiln inner cylinder
9 Connecting portion
10 Outer cylinder
11 Movable support portion
12 Fixed support portion
13 Ring-shaped frame

14 Support member
15 Control device
16 Drive device
17 Gear
18 Drive motor
19 Pinion gear
20 Heating gas supply pipe
21 Heating gas furnace (heater)
22 Heating gas feeding pipe
23 Heating gas amount adjustment device
24 Heating gas amount adjustment damper
25 Induction fan
26 inspection window
27 Non-contact type thermometer
29 First inner cylinder main body portion
30 First conical portion
31 First small diameter portion (Upstream-side cylindrical portion)
32 Second inner cylinder main body portion
33 Second conical portion
34 Second small diameter portion (Downstream-side cylindrical portion)
36 Frame main body portion
37 Bearing retaining portion
38 Bearing
39 End wall portion
40 Ring-shaped protrusion
41 Sealing plate
42 Presser plate
43 Expansion member
44 Gland packing
F Installation surface

The invention claimed is:

1. An externally heated carbonization furnace comprising:

first and second rotary kilns which are adjacent to each other and connected in series via a connecting portion, each of the rotary kilns including an outer cylinder, a kiln inner cylinder that is rotatable with respect to the outer cylinder, and a heater configured to supply heating gas to each section between the outer cylinder and the kiln inner cylinder;

drive devices configured to individually rotate a first kiln inner cylinder of the first rotary kiln on an upstream side with respect to the second rotary kiln and a second kiln inner cylinder of the second rotary kiln on a downstream side; and a control device configured to control the drive devices so that a temperature of the kiln inner cylinder on the upstream side is maintained within a first predetermined temperature range in which moisture in the treated object is evaporated and a temperature of the kiln inner cylinder on the downstream side is maintained within a second predetermined temperature range in which the treated object is carbonized;

wherein the connecting portion includes:

an upstream cylindrical portion communicating with an internal space of the first kiln inner cylinder and configured to rotate together with the first kiln inner cylinder;

a downstream cylindrical portion communicating with an internal space of the second kiln inner cylinder and configured to rotate together with the second kiln inner cylinder, wherein the upstream cylindrical portion is inserted into the downstream cylindrical portion;

a fixed support portion provided at an end portion of the first kiln inner cylinder of the first rotary kiln in the connection portion, and configured to rotatably support the first kiln inner cylinder about an axis thereof via a first ring-shaped frame;

a movable support portion provided at an end portion of the second kiln inner cylinder of the second rotary kiln in the connection portion so as to be movable in a direction of an axis of the second kiln inner cylinder, and configured to rotatably support the second kiln inner cylinder about the axis thereof via a second ring-shaped frame;

a first bearing retaining portion protruded from the first ring-shaped frame toward the first kiln inner cylinder along the axis thereof;

a first ring-shaped protrusion protruded from an end wall portion of the first kiln inner cylinder and which is supported by the first bearing retaining portion via a first bearing installed on an outer circumference of the first bearing retaining portion;

a second bearing retaining portion protruded from the second ring-shaped frame toward the second kiln inner cylinder along the axis thereof;

a second ring-shaped protrusion protruded from an end wall portion of the second kiln inner cylinder and which is supported by the second bearing retaining portion via a second bearing installed on an outer circumference of the second bearing retaining portion; and an expansion member connecting the fixed and movable support portions and which is expandable in an axial direction of the outer cylinders while sealing the first and second kiln inner cylinder.

2. The externally heated carbonization furnace according to claim 1, wherein the connecting portion further includes:

a first conical portion formed between a first main body portion of the first kiln inner cylinder and the upstream cylindrical portion, and of which diameter is gradually reduced as it extends further toward the upstream cylindrical portion in a direction of the axis of the first kiln inner cylinder from the first main body portion so as to be formed into a conical shape;

a first sealing plate protruded radially outward from the outer circumferential surface of the first conical portion or the upstream cylindrical portion, and extended in a circumferential direction thereof;

a second conical portion formed between a second main body portion of the second kiln inner cylinder and the downstream cylindrical portion, and of which diameter is gradually reduced as it extends further toward the downstream cylindrical portion in a direction of the axis of the second kiln inner cylinder from the second main body portion so as to be formed into a conical shape; and a second sealing plate protruded radially outward from the outer circumferential surface of the second conical portion or the downstream cylindrical portion, and extended in a circumferential direction thereof; wherein the first sealing plate faces a first ring-shaped presser plate attached to the first ring-shaped frame and is connected to the first ring-shaped presser plate via a first gland packing fixed to the first sealing plate, and the second sealing plate faces a second ring-shaped presser plate attached to the second ring-shaped frame and is connected to the second ring-shaped presser plate via a second gland packing fixed to the second sealing plate.

3. The externally heated carbonization furnace according to claim 1, wherein rotational frequencies of the kiln inner cylinders are controlled according to at least one of a temperature of the first kiln inner cylinder and a temperature of the second kiln inner cylinder.

4. The externally heated carbonization furnace according to claim 1, wherein the control device includes a heating gas amount adjustment damper configured to adjust a flow rate of the heating gas to be supplied from the heater.

* * * * *